US005839299A

United States Patent [19]

Lee

[11] Patent Number: 5,839,299

[45] Date of Patent: Nov. 24, 1998

[54] PULSATOR OF WASHING MACHINE

[75] Inventor: Jae-Yoll Lee, Kyungki-Do, Rep. of Korea

[73] Assignee: Daewoo Electronics Co., Ltd., Seoul, Rep. of Korea

[21] Appl. No.: 807,949

[22] Filed: Feb. 28, 1997

[30] Foreign Application Priority Data

Feb. 29, 1996 [KR] Rep. of Korea ..... 1996-3516

[51] Int. Cl.[6] ..... D06F 37/00

[52] U.S. Cl. ..... 68/134; 366/317; 366/329.1; 68/133

[58] Field of Search ..... 68/23.3, 133, 134; 366/243, 241, 247, 342, 343, 317, 329.1, 326.1, 326.2; 134/188

[56] References Cited

U.S. PATENT DOCUMENTS

| | | | |
|---|---|---|---|
| 1,436,172 | 11/1922 | Holmgren et al. | 366/326.1 |
| 1,705,639 | 3/1929 | Fahlberg | 366/317 |
| 1,765,067 | 6/1930 | Frantz | 68/133 |
| 1,789,939 | 1/1931 | Geldhof | 68/133 |
| 1,805,107 | 5/1931 | Rocke | 68/134 |
| 1,861,640 | 6/1932 | McCabe | 68/133 |
| 1,863,546 | 6/1932 | Snyder | 68/133 |
| 1,978,113 | 10/1934 | McCabe | 68/134 |
| 1,994,741 | 3/1935 | Altorfer | 366/343 |
| 3,199,575 | 8/1965 | Keller | 366/326.1 |
| 3,241,820 | 3/1966 | Clough | 366/326.1 |
| 3,446,044 | 5/1969 | Mischke | 36/326.1 |
| 4,102,156 | 7/1978 | James | 68/134 |
| 4,192,615 | 3/1980 | Fortunski et al. | 366/329.1 |
| 4,545,220 | 10/1985 | Ishida et al. | 68/134 |
| 4,719,769 | 1/1988 | Pielemeier . | |
| 4,787,220 | 11/1988 | Noh . | |
| 5,285,664 | 2/1994 | Chang et al. . | |
| 5,473,916 | 12/1995 | Ye | 68/134 |

FOREIGN PATENT DOCUMENTS

| | | | |
|---|---|---|---|
| 1075451 | 4/1954 | France | 68/133 |
| 1019272 | 11/1957 | Germany | 68/134 |
| 6-198153 | 7/1994 | Japan | 68/326.1 |
| 1092045 | 5/1984 | U.S.S.R. | 366/342 |
| 2073034 | 10/1981 | United Kingdom | 366/343 |

*Primary Examiner*—Frankie L. Stinson
*Attorney, Agent, or Firm*—Cushman Darby & Cushman Intellectual Property Group of Pillsbury Madison & Sutro, LLP

[57] ABSTRACT

Disclosed is a pulsator of a washing machine. A rotating plate which rotates by a driving part, is provided. A plurality of vanes are radially positioned at a predetermined distance apart from each other on the rotating plate. An irregular water flow generating part rotatably mounted on the rotating plate, is provided for generating an irregular water flow. When the rotating plate rotates, the irregular water flow generating part rotates in the direction opposite to the rotational direction of the rotating plate to change a regular washing water flow generated by the plurality of vanes into an irregular water flow. The washing ability of the washing machine is improved and the tangling of clothing can be prevented. Further, the manufacturing cost of the washing machine can be reduced.

5 Claims, 4 Drawing Sheets

PULSATOR OF WASHING MACHINE

BACKGROUND OF THE INVENTION

1. Field of the Invention

The present invention relates to a pulsator of a washing machine, and more particularly to a pulsator of a washing machine having attachable and detachable vanes installed therein.

2. Description of the Prior Art

Generally, a washing machine is an appliance for washing soiled clothing by carrying out the cycles of water supplying, washing, water draining, dehydrating, water supplying, rinsing, water draining and dehydrating. During the prosecution of the cycles of the washing and the rinsing, a pulsator provided on the bottom portion of a washing tub rotates in order to generate a washing water flow. Dirt contained in the clothing is separated from the clothing by means of frictions between the washing water flow and the clothing, and between the washing tub and the clothing. At this time, a detergent is added into the washing tub for effectively separating the dirt.

The washing machine includes the washing tub for receiving the clothing and washing water, the pulsator for generating the washing water flow, provided on the bottom portion of the washing tub, a driving part for rotating the pulsator and a controlling part for prosecuting the cycles.

The pulsator has a rotating plate which rotates by the driving part, and vanes provided on the upper surface of the rotating plate. When the rotating plate starts to rotate by receiving the driving force from the driving part, the vanes generate the washing water flow in the washing tub. The dirt is separated from the clothing by the friction between the washing water flow and the clothing contained in the washing tub. At this time, the formation of the washing water flow depends on the shape of the pulsator, and particularly on the shape of the vanes.

If the pulsator rotates in one direction, the clothing in the washing tub get tangled. This is one of the causes of deterioration of the washing ability of the washing machine. Accordingly, in order to prevent the tangling of the clothing by the pulsator during the cycles of the washing and the rinsing, the pulsator continuously changes its rotational direction from clockwise to counterclockwise, or from counterclockwise to clockwise.

FIG. 1 shows a pulsator 10 of a washing machine illustrated in U.S. Pat. No. 5,421,174, issued to Kim et al. on Jun. 6, 1995. Pulsator 10 includes a rotating plate 12 and a plurality of vanes 14 positioned on rotating plate 12. Rotating plate 12 and vanes 14 are integrally formed, and rotating plate 12 rotates by a motor (not shown). Vanes 14 are radially disposed on rotating plate 14. When rotating plate 12 rotates, a plurality of vanes 14 generate a washing water flow for separating dirt contained in clothing by the friction between the washing water flow and the clothing.

However, since a plurality of vanes 14 are radially disposed and the rotating power of vanes 14 at the inner portion and at the outer portion are different, the washing water flow produced by rotating plate 12 concentrates at the center portion of pulsator 10. Accordingly, the clothing gets tangled, so the washing ability of the washing machine is deteriorated.

SUMMARY OF THE INVENTION

Accordingly, it is an object of the present invention to provide a pulsator of a washing machine having an improved washing ability by generating an irregular washing water flow and by preventing the tangling of clothing.

To accomplish the above object of the present invention, there is provided a pulsator of a washing machine comprising a rotating plate rotating by a motor, a plurality of vanes radially disposed on the rotating plate, and an irregular water flow generating part rotatably mounted on the rotating plate and rotatable to a predetermined degree, for generating an irregular washing water flow.

A hole extending from the upper surface to the lower surface of the rotating plate is formed at the rotating plate, and a butterfly-shaped rotatable groove is formed at the upper portion of the hole.

The irregular water flow generating part comprises a shaft rotatably inserted into the hole, a base connected to an upper end portion of the shaft, an auxiliary vane connected to the upper end portion of the base, for generating the irregular water flow, and a stop ring inserted from the lower surface of the rotating plate into the lower end portion of the shaft.

When the rotating plate rotates clockwise by the driving part, the auxiliary vane rotates in the direction opposite to the rotating direction of the rotating plate, that is, counterclockwise to a predetermined degree, so that the vanes are differently disposed from the other vanes. At this time, the direction of the regular washing water flow generated by the vanes changes at the auxiliary vanes, and an irregular water flow is generated. When the rotating plate rotates counterclockwise, the auxiliary vane rotates clockwise to generate the irregular washing water flow.

As described above, the pulsator of the washing machine according to the present invention generates an irregular water flow to improve the washing ability of the washing machine and to prevent the tangling of clothing. In addition, since the structure of the pulsator is simple, the manufacturing cost of the washing machine can be reduced.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE INVENTION

Hereinafter, the constituting elements and the operation principles of the pulsator according to a preferred embodiment of the present invention will be explained in more detail with reference to the accompanying drawings.

Figure 1:
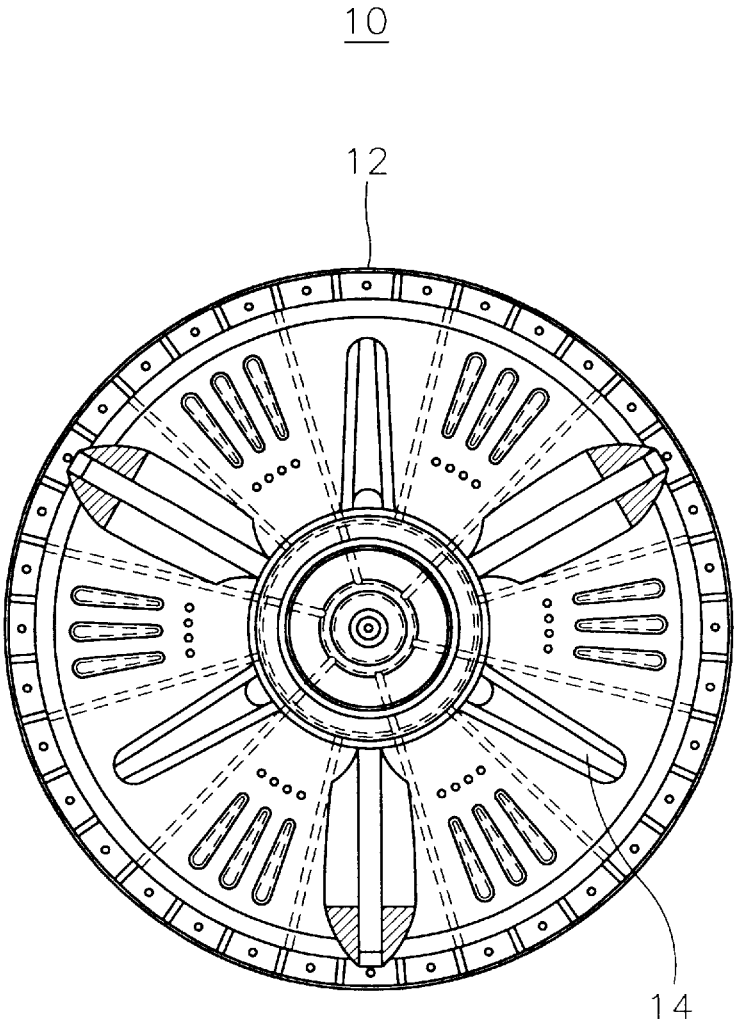
FIG. 1 (PRIOR ART)
FIG. 1 is the conventional pulsator of a washing machine.
Figure 2:
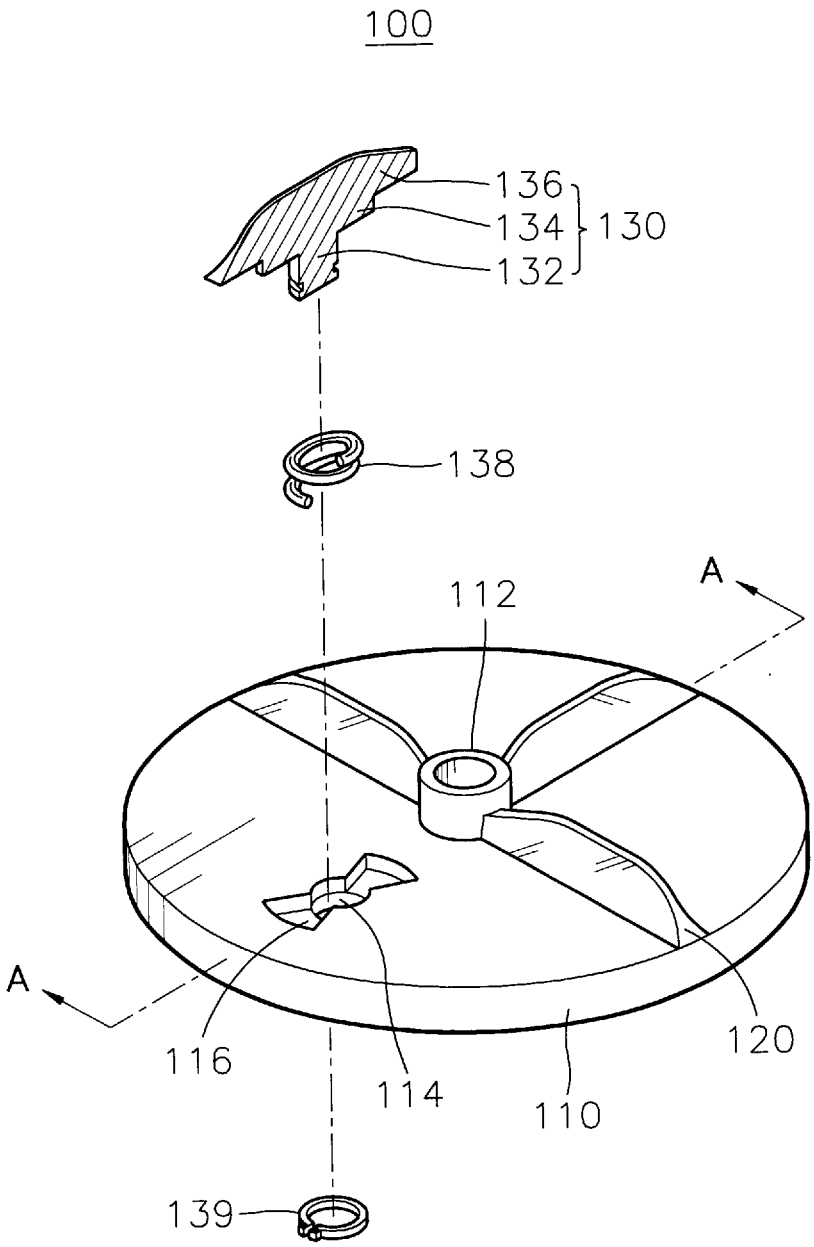
FIG. 2 is an exploded perspective view of a pulsator of a washing machine according to one embodiment of the present invention.

FIG. 2 illustrates an exploded perspective view for showing a pulsator 100 of a washing machine according to one embodiment of the present invention. In the drawing, pulsator 100 includes a rotating plate 110 provided on the bottom portion of a washing tub and dynamically connected to a driving part (not shown) of the washing machine in order to rotate the rotating plate 110, a plurality of vanes 120 radially disposed at a predetermined distance apart from each other on the upper surface of rotating plate 110, and an irregular water flow generating part 130 rotatably attached to rotating plate 110.

Rotating plate 110 is formed in a circular shape and has a hole 114 extending from the upper surface to the lower surface of rotating plate 110. Hole 114 is formed where irregular water generating part 130 is located. A rotatable groove 116 is formed around hole 114. Rotatable groove 116 is formed in a butterfly-shape. At the center portion of rotating plate 110, a boss 112, which is connected to the driving part, is provided. At the lower portion of the inner circumference of hole 114, a first groove 115 is formed, as shown in FIG. 3.

On the upper surface of rotating plate 110, a plurality of vanes 120 are radially provided at a predetermined distance apart from each other. Rotating plate 110 and plurality of vanes 120 are integrally formed. During the rotation of rotating plate 110, a plurality of vanes 120 generate a regular washing water flow.

Irregular water flow generating part 130 includes a shaft 132 which has a second hole 137 formed at its upper portion and is rotatably inserted into hole 114, a base 134 slidably inserted into each of rotatable grooves 116 and an auxiliary vane 136 connected to the upper end portion of base 134. When rotating plate 110 rotates, base 134 slides in a clockwise or a counterclockwise direction within a predetermined angle range in accordance with the angle of the wing portion of rotatable groove 116.

Figure 3:
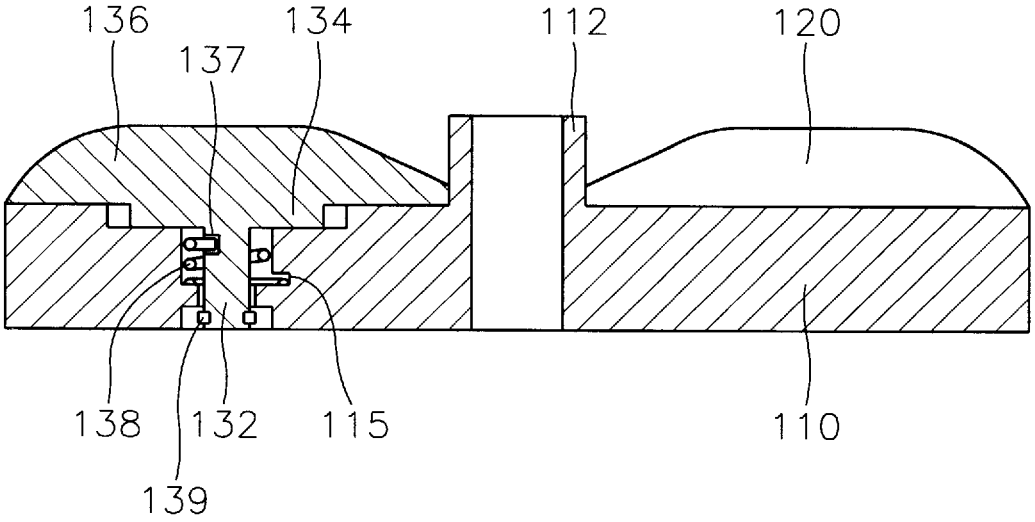
FIG. 3 is a cross-sectional view of the pulsator shown in FIG. 2, cut along the line of A—A.

In addition, as shown in FIG. 3, irregular water flow generating part 130 is provided with a spring 138 for applying an elastic force onto shaft 132, and a stop ring 139 inserted into the lower end portion of shaft 132, for preventing the separation of shaft 132 from rotating plate 110. Spring 138 wraps around shaft 132. One end of spring 138 is fixed to first groove 115 and the other end of spring 138 is fixed by being inserted into second groove 117 of shaft 132.

A slot 135 is formed at the lower end portion of the outer circumference of shaft 132. Stop ring 139 is inserted into slot 135. Base 134 slides and rotates to a predetermined degree within rotatable groove 116. Auxiliary vanes 136 generate the irregular water flow through a collision with washing water.

The operation of pulsator 100 of the washing machine according to the present invention described above, will be explained.

Figure 4:
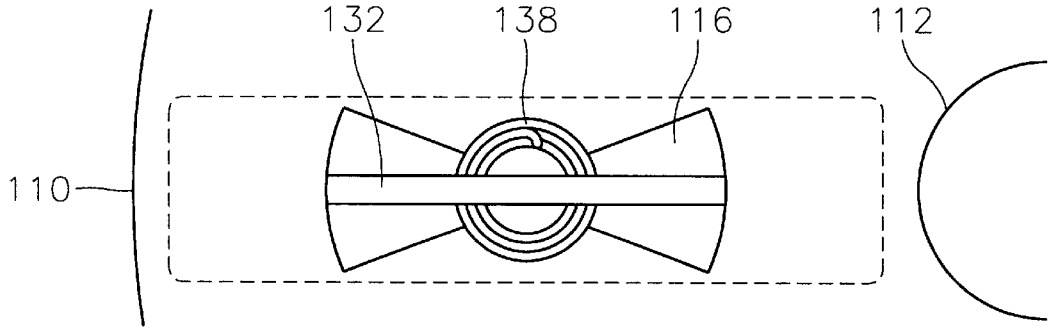
FIGS. 4, 5 & 6 are planar views for explaining the operation of an auxiliary vane shown in FIG. 2.

As illustrated in FIG. 4, when rotating plate 110 is in a stationary state, auxiliary vane 136 is positioned at the center portion of rotatable groove 116 by the elastic force of spring 138.

Figure 5:
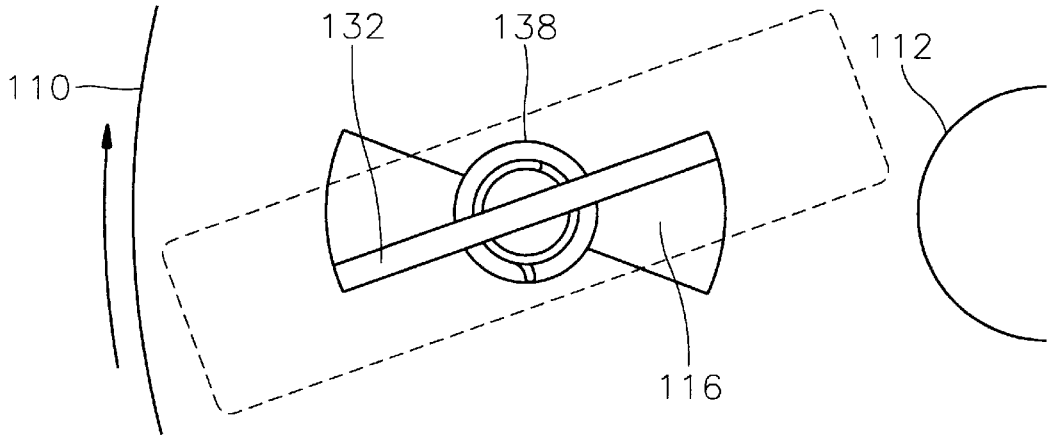

However, when rotating plate 110 starts to rotate clockwise by the driving part, a plurality of vanes 120 generate a regular water flow by colliding with the washing water in the washing tub. At this time, auxiliary vanes 136 of irregular water flow generating parts 130 rotate in the direction opposite to the rotating direction of rotating plate 110, that is, counterclockwise, to a predetermined degree, as shown in FIG. 5. Accordingly, the regularity of the regular water flow formed by the vanes 120 is broken off to produce the irregular water flow.

Figure 6:
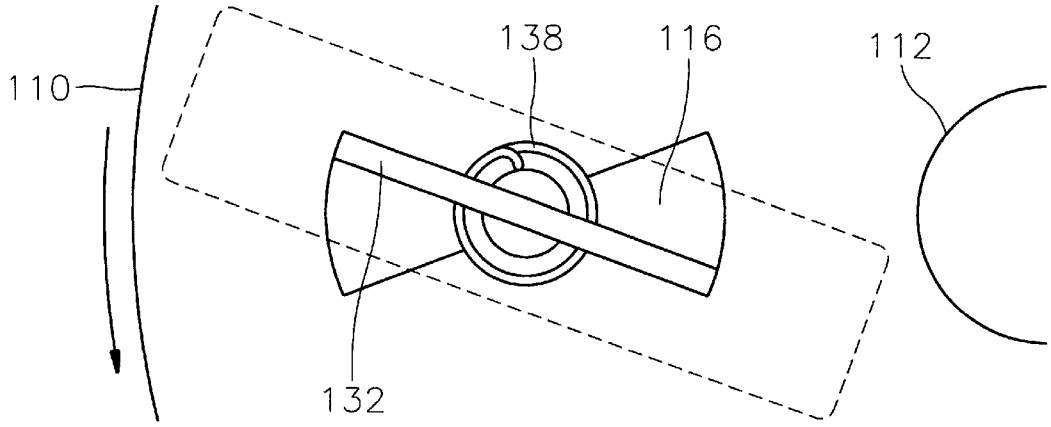

Alternately, when rotating plate 110 starts to rotate counterclockwise, the plurality of vanes 120 generate a regular washing water flow having a different direction. At this time, auxiliary vanes 136 rotate clockwise within rotatable grooves 116 to a predetermined degree, as illustrated in FIG. 6. Accordingly, the regular washing water flow formed by a plurality of rotating vanes 120 changes into an irregular water flow by auxiliary vanes 136.

Since spring 138 imparts an elastic force to each of auxiliary vanes 136 when each of auxiliary vane 136 rotates to a predetermined degree, auxiliary vanes 136 vibrate during the rotation of rotating plate 110. This effectively enhances the generation of the irregular water flow.

Therefore, the irregular washing water flow is continuously generated in the washing tub and the tangling of clothing in the washing tub can be prevented. Further, the frictional force between the irregular washing water flow generated by auxiliary vanes 136 and the clothing is increased and the washing ability is improved.

As described above, the pulsator of the washing machine according to the present invention effectively forms the irregular washing water flow in the washing tub. Therefore, the washing ability of the washing machine can be improved and the tangling of the clothing can be prevented.

In addition, the pulsator of the washing machine according to the present invention has a simple structure and the manufacture thereof is very advantageous. Accordingly, the manufacturing cost of the washing machine can be reduced.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A pulsator of a washing machine comprising:

a rotating plate provided at a bottom portion of a washing tub and dynamically connected to a driving part of said washing machine for rotating said rotating plate, a hole extending from an upper surface to a lower surface of said rotating plate and being formed in said rotating plate;

a plurality of vanes radially formed on an upper portion of said rotating plate at a predetermined distance apart from each other, for generating a regular washing water flow; and an irregular water flow generating means rotatably mounted on said rotating plate, for generating an irregular water flow.

2. A pulsator of a washing machine as claimed in claim 1, wherein said irregular water flow generating means comprises:

a shaft inserted into the hole and rotatable to a predetermined degree;

a base connected to an upper end portion of said shaft; and an auxiliary vane connected to an upper end portion of said base for generating said irregular water flow.

3. A pulsator of a washing machine as claimed in claim 2, wherein said irregular water flow generating means further comprises:

a spring wrapping around said shaft and fixed to the hole and to said shaft, for applying an elastic force to said shaft; and a stop ring inserted into a lower end portion of said shaft, for preventing a separation of said shaft from said rotating plate, and a first groove to which a first end of said spring is fixed is formed at a lower portion of an inner circumference of the hole of said shaft and a second groove to which a second end of said spring is fixed is formed at an upper portion of said shaft.

4. A pulsator of a washing machine as claimed in claim 2, wherein said rotating plate further has a rotatable groove formed around an upper portion of the hole so that said base slides and rotates within said rotatable groove.

5. A pulsator of a washing machine comprising:

a rotating plate provided at a bottom portion of a washing tub and dynamically connected to a driving part of said washing machine for rotating said rotating plate, a hole extending from an upper surface to a lower surface of said rotating plate and being formed in said rotating plate, a rotatable groove formed at an upper portion of the hole, a first groove formed at an upper portion of the hole;

a plurality of vanes radially formed on an upper portion of said rotating plate at a predetermined distance apart from each other, for generating a regular washing water flow; and an irregular water flow generating part comprising a shaft which has a second groove formed at an upper portion thereof and is rotatably inserted into the hole, a base connected to an upper end portion of said shaft and sliding and rotating within said rotatable groove, an auxiliary vane connected to an upper end portion of said base, for generating an irregular water flow, a stop ring inserted into a lower end portion of said shaft, and a spring wrapping around said shaft for applying an elastic force to said shaft and being fixed to the first groove and the second groove.

* * * * *